United States Patent [19]

Raymond

[11] Patent Number: 4,882,972

[45] Date of Patent: Nov. 28, 1989

[54] DUAL CALIBER AMMUNITION HANDLING SYSTEM

[75] Inventor: Eugene B. Raymond, Essex Junction, Vt.

[73] Assignee: General Electric Company, Burlington, Vt.

[21] Appl. No.: 232,410

[22] Filed: Aug. 15, 1988

[51] Int. Cl.[4] ..... F41D 10/22; F41F 9/02; B65G 37/00

[52] U.S. Cl. ..... 89/34; 198/473.1

[58] Field of Search ..... 198/473.1, 465.3, 803.11, 198/803.14; 89/34; 86/47

[56] References Cited

U.S. PATENT DOCUMENTS

| | | | |
|---|---|---|---|
| 3,970,188 | 7/1976 | Smorenburg | 198/803.14 |
| 4,434,700 | 3/1984 | Aloi et al. | 89/34 |
| 4,573,395 | 3/1986 | Stoner | 89/34 |
| 4,633,998 | 1/1987 | Norfolk | 198/465.3 |
| 4,778,045 | 10/1988 | Grüne et al. | 198/803.14 |
| 4,807,421 | 2/1989 | Araki et al. | 198/803.11 |

*Primary Examiner*—David H. Brown

*Attorney, Agent, or Firm*—Bailin L. Kuch; Robert A. Cahill

[57] ABSTRACT

An ammunition resupply system includes a chain ladder ammunition conveyor having carrier elements configured to accept either of two different calibers of ammunition. The ammunition conveyor is trained in a serpentine path back and forth between adjacent pairs of guide shelves supported one atop another in stacked relation. The guide shelves are integrally formed with opposing round engaging and round control surfaces between which the ammunition rounds are conveyed to provide positive round guidance and control effective in maintaining the ammunition round properly positioned between adjacent pairs of conveyor carrier elements.

34 Claims, 4 Drawing Sheets

DUAL CALIBER AMMUNITION HANDLING SYSTEM

The present invention relates generally to articles handling systems and particularly to an ammunition resupply system capable of handling two different calibers of ammunition rounds for loading a rapid-fire system of either caliber.

BACKGROUND OF THE INVENTION

A modern rapid-fire gun system includes an ammunition storage container or magazine in which rounds of ammunition are held for successive delivery by an ammunition conveyor to a rapid-fire gun or cannon. Typically, the handoff of each live round from the ammunition conveyor to the gun is immediately followed by the handback to the conveyor of a spent ammunition round. Thus the ammunition conveyor is fashioned in an endless loop such that it can both convey live rounds from rounds or shell casings from the gun back to the magazine for storage. Ultimately, the supply of live rounds is depleted, leaving the magazine filled with spent rounds. The magazine must then be emptied of spent rounds and reloaded with live rounds.

To serve this reloading or resupply function, ammunition resupply systems have been developed. These systems are interfaced with the gun system magazine and a series of live round for spent round exchange are performed typically in much the same fashion as are the exchanges between the magazine and the gun, albiet at a rate considerably less than gun firing rate. Thus, the supply system may include an endless supply conveyor for successively delivering live rounds from storage to the resupply system-magazine interface or transfer station where they are handed off to the magazine conveyor in exchange for spent rounds for conveyance back into storage.

Of course, a resupply system must handle the same caliber of ammunition as the gun system it serves and heretofore has been exclusively so designed. There is currently a trend, especially for shipboard installation, to upgrade gun systems to a larger caliber of ammunition, e.g., from a 20 millimeter to a 25 millimeter gun system. This means that the existing 20 millimeter resupply system could not serve to reload the 25 millimeter gun system and would have to be replaced with a new resupply system designed to handle the larger caliber ammunition rounds. This obviously represents an additional expense. It would be desirable, knowing that at some future date a gun system will be replaced with one of a larger caliber, to provide a supply system capable of handling the present,small caliber ammunition rounds, as well as the future, larger caliber ammunition This approach is deemed to be far more cost effective than either replacing the resupply system altogether or intially designing the system such that it can be converted from the smaller to the larger caliber. This latter approach would obviously require a wholesale changeout of internal components when the conversion to the larger caliber is made.

Another situation where dual caliber resupply system capability would be beneficial is in those installations having multiple gun systems of different calibers. A single dual caliber supply system design could thus serve the various calibers of gun systems with consequent savings in manufacturing costs, replacement parts inventory, and maintenance.

It is accordingly an object of the present invention to provide an improved article handling system.

Another object is to provide an improved system of the above-character for handling rounds of ammunition.

An additional object is to provide an ammunition handling system of the above-character which is capable of handling different calibers of ammunition rounds.

A further object is to provide an ammunition handling system of the above-character wherein its total caliber round handling capability is achieved without changeout of its internal parts.

Another object is to provide an improved ammunition handling system which is rugged in construction, efficient to manufacture and service, and reliable in operation.

Other objects of the invention will in part be obvious and in part appear hereinafter.

SUMMARY OF THE INVENTION

In accordance with the present invention, there is provided an ammunition handling system comprising a ladder-type ammunition conveyor having a pair of endless chains interconnected at regular intervals by transverse ammunition round carrier elements between which the individual rounds are accommodated. The ammunition conveyor is trained around spaced sets of turnaround sprockets in a serpentine conveyor path to convey ammunition rounds to a transfer station where successive live round-spent round exchanges are effected. Control and guidance of ammunition round movement along the straight runs of the serpentine conveyor path between turnaround sprocket sets is provided by opposed surfaces of plural, elongated guide shelves supported on one another in a stacked array. The guide shelf surfaces and confronting surface formations of each consecutive pair of carrier elements are transversely arranged and contoured to afford positive round control during the conveyance of either one of at least two different calibers of ammunition. In addition to their ammunition round control and guidance functions, the guide shelves are commonly structured to rotatably mount a set of turnaround sprockets at either end thereof.

The invention accordingly comprises the features of construction, combinations of elements, and arrangements of parts, all of which will be exemplified in the construction hereinafter set forth, and the scope of the invention will be indicated in the claims.

For a fuller understanding of the nature and objects of the invention, reference may be had to the following description taken in connection with the accompanying drawings, in which.

Corresponding reference numerals refer to like parts throughout the several views of the drawings.

DETAILED DESCRIPTION

Figure 1:
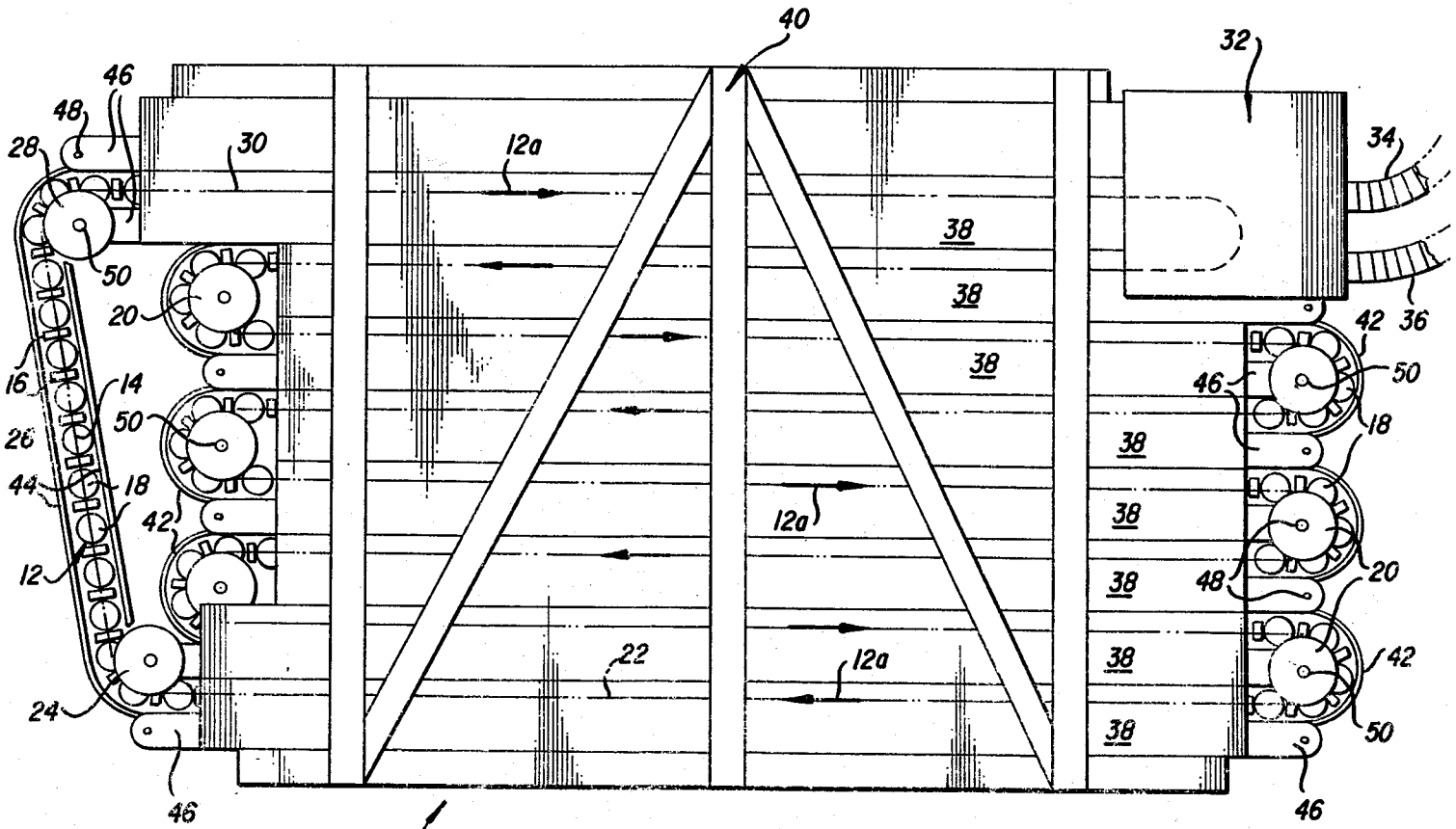
FIG. 1 is a side elevational view of an ammunition resupply system constructed in accordance with the present invention.

The ammunition handling handling system of the present invention is illustrated in FIG. 1 as embodied in an ammunition resupply system, generally indicated at 10. This system includes an endless, chain ladder ammunition conveyor, generally indicated at 12, consisting of a pair of transversely opposed chains 14 interconnected at uniformly spaced intervals along their lengths by transverse carrier elements 16 in the manner of ladder rungs. Linkless rounds of ammunition 18, either live or spent rounds, are normally accommodated between each adjacent pair of carrier elements for conveyance by conveyor 12. The conveyor chains are trained around horizontally and vertically spaced sets of transversely opposed pairs of turnaround sprockets 20 in a serpentine conveyor path to maximize the ammunition round storage density of the resupply system 10. From the lowest straight run 22 of the conveyor serpentine path, the conveyor chains are trained around a set of transversely opposed sprockets 24 into an unwardly directed straight conveyor path run 26 and around a set of transversely opposed sprockets 28 into the uppermost straight serpentine path run 30.

Assuming conveyor 12 is driven in the direction indicated by arrows 12*a*, live ammunition rounds are conveyed from the lowest straight serpentine path run 22 upperwardly along straight run 26 to uppermost straight serpentine path run 30 and then rightward to a round transfer station, generally indicated at 32. Since this transfer station forms no part of the present invention, its details are not shown in sake of brevity. Suffice it to say that round transfer station 32 includes a suitable transfer mechanism operating to pick off live ammunition rounds from their positions between carrier elements 16 as successively presented by conveyor 12 and to transfer the picked off rounds to flexible chuting 34 for loading into a rapid-fire gun system (not shown). Typically, spent ammunition rounds or shell cases are unloaded from the gun system and delivered via flexible chuting 36 to transfer station 32 for successive handoff by the transfer mechanism into the spaces between the carrier elements from which live rounds had just been picked off. From the transfer station, the ammunition conveyor is trained by the sets of turnaround sprockets 20 through successively lower straight serpentine path runs, to the lowest one 22, thus completing its endless loop path.

To afford positive control and guidance of the ammunition rounds 18 during conveyance along the straight serpentine path runs, the present invention provides a plurality of guide shelves 38 held in a stacked array by a suitable frame, generally indicated at 40 in FIG. 1. Arcuate guides 42 are mounted at the ends of these guide shelves in properly spaced relation to the sets of turnaround sprockets 20 to provide control and guidance of the ammunition rounds 18 as they execute the short, interconnecting arcuate runs between straight serpentine path runs. Opposed guides 44 control and guide the ammunition rounds as they move through conveyor path 26 between the lowest and uppermost straight serpentine path runs 22 and 30, respectively. Basically these guides serve to maintain the ammunition rounds in their proper positions between carrier elements 16 as they are conveyed by conveyor 12 along its tortuous loop path.

As also seen in FIG. 1, guide shelves 38 are advantageously formed at each end with a transversely opposed pair of longitudinally projecting tongues 46, each fashioned with a bore 48 through which the shaft 50 for a set of turnaround sprockets 20, as well as sprockets 24 and 28, is received and journalled for rotation. To provide the serpentine conveyor path formation, the turnaround sprocket sets are mounted at alternate ends of the successive guide shelves 38 of the stack. The unused tongues 46 do not obstruct ammunition round conveyance, and thus may be left intact, as illustrated. Thus, the guide shelves can be ideally fabricated as a common design varying only in length, thus affording manufacturing and inventory economies.

Figure 2:
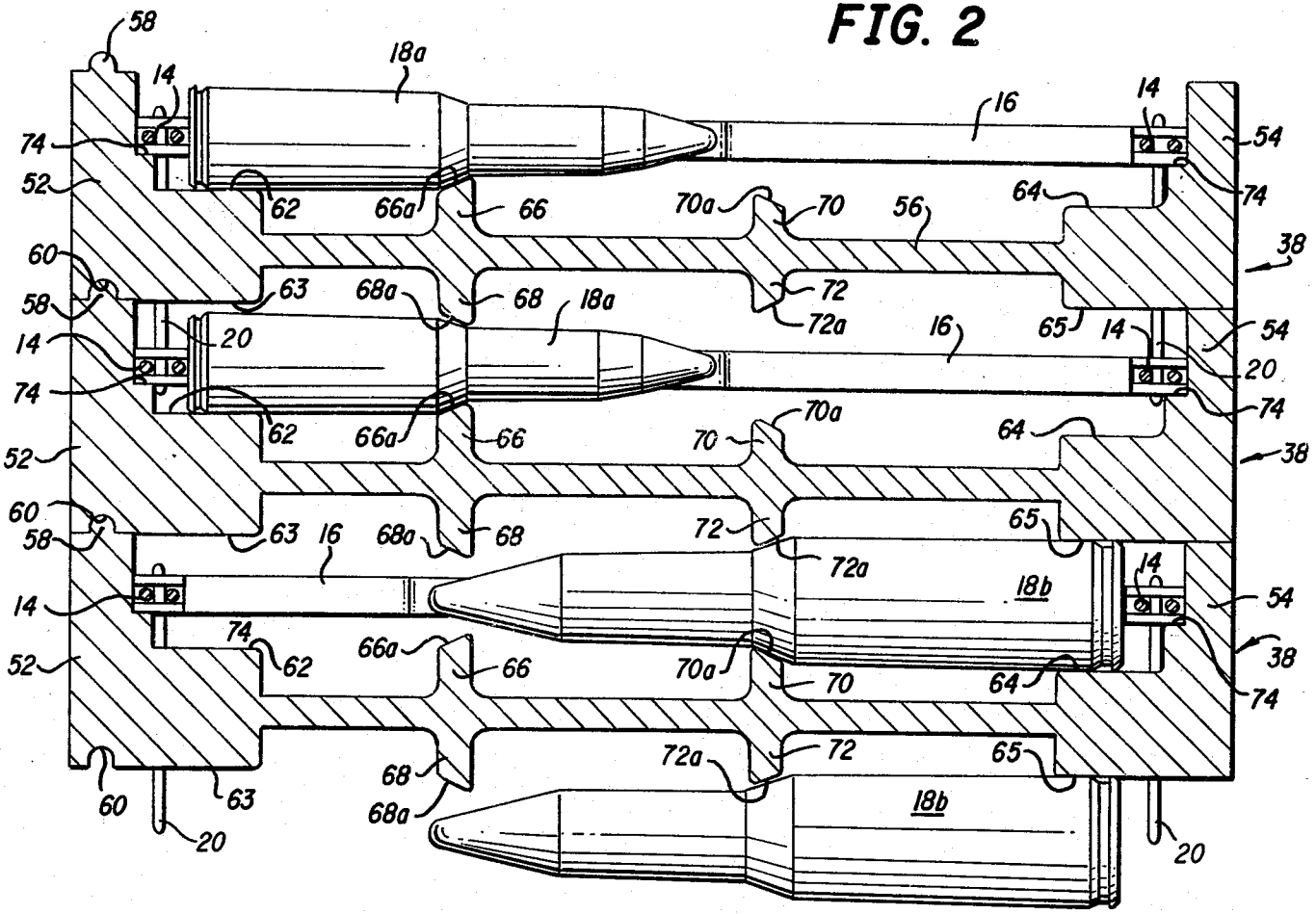
FIG. 2 is a fragmentary, transverse sectional view of the resupply system of FIG. 1, showing the dual caliber handling capability thereof.

Turning to FIG. 2, a partial stack of three guide shelves 38 is shown in transverse cross section. Each identical guide shelf includes opposed longitudinal sidewalls 52 and 54 interconnected by a floor 56. The upper edge of at least each left sidewall 52 is formed with a longitudinal ridge 58, which may extend the full guide shelf length, while the lower edge of each left sidewall is formed with a confronting longitudinal groove 60. Thus, when the guide shelves are clamped in stacked relation by frame 40 (FIG. 1), the ridges 58 are received in the complementarily-shaped grooves 60 to lock the guide shelves against transverse relative movement. It is found that an interlocking arrangement of this type at only one of the shelve sidewalls is sufficient, and thus the other, right sidewalls 54 are provided with flat edges on which the sidewalls simply rest one atop the other, as illustrated in FIG. 2.

As a feature of the present invention, the guide shelves are transversely expanded so as to accommodate two different calibers of ammunition, as seen in FIG. 2. To this end, the left sidewalls 52 are inwardly formed with upper and lower shoulders 62 and 63, respectively, while the right sidewalls 54 are inwardly formed with upper and lower shoulder 64 and 63, respectively; these shoulders running the full guide shelf length. Inwardly from shoulders 62 and 63, the floor 56 of each guide shelf is formed with a full-length upstanding rib 66 and a vertically aligned, full-length depending rib 68. The upper edge of each rib 66 is contoured to provide a guide surface 66*a*, while the lower edge of each rib 68 is contoured to provide a control surface 68*a*. Similarly, the floor 56 of each guide shelf is provided at a location inwardly of shoulders 64 and 65 with a full-length upstanding rib 70 and a vertically aligned, coextensive depending rib 72. The upper edge of each rib 70 is contoured to provide a guide surface 70a, and the lower edge of each rib 72 is contoured to provide a control surface 72a.

If the resupply system 10 is to handle a smaller caliber of ammunition, such as 20 millimeter rounds 18*a*, they are accommodated between the conveyor carrier elements 16 to the left side of the guide shelves 38 with their projectile ends directed rightwardly or inwardly. Thus the base end portions of ammunition round shell casings ride on and are guided by the shoulder 62 of one guide shelf and are controlled by the opposing shoulder 63 of the immediately overlying guide shelf to preserve the positions of ammunition rounds 18*a* between carrier elements 16 as they move along the straight serpentine path runs between adjacent pairs of guide shelves. Similarly, the tapered necks of the shell casings ride on and are guided by the rib guide surfaces 66*a* and are controlled by the opposing rib control surfaces 68*a* to also maintain the ammunition rounds 18*a* properly positioned between the carrier elements. Note that the angular contour of these rib surfaces engage the tapered shell casing necks to also control the axial or endwise positions of the ammunition rounds 18*a* as they are conveyed by conveyor 12 along the straight serpentine path runs between the floors 56 of adjacent pairs of guide shelves. It will also be noted that, since guidance and control of ammunition round movement is exerted solely on the shell casings, the resupply system can reliably handle both live and spent ammunition rounds.

When resupply system 10 is to handle a larger caliber of ammunition, such as 25 millimeter rounds 18*b*, the right side of the guide shelves is utilized. Thus, as seen in FIG. 2, the base end portions of the shell casings ride on and are guided by shoulders 64 and controlled by opposed shoulders 65, while the tapered necks thereof ride on and are guided by rib guide surfaces 70*a* and controlled by opposed rib guide surfaces 72*a*, as the ammunition rounds 18*b* are conveyed by conveyor 12 along the straight serpentine path runs between guide shelves 38. Again, either live or spent rounds are reliably handled, and the proper axial positions of ammunition rounds 18*b* are maintained by opposed rib surfaces 70*a*, 72*a*.

As also seen in FIG. 2, the left and right guide shelf sidewalls 52 and 54, respectively, are formed with opposed, unwardly extending ledges 74 to serve as running guides for the opposed conveyor chains 14.

Figure 3:
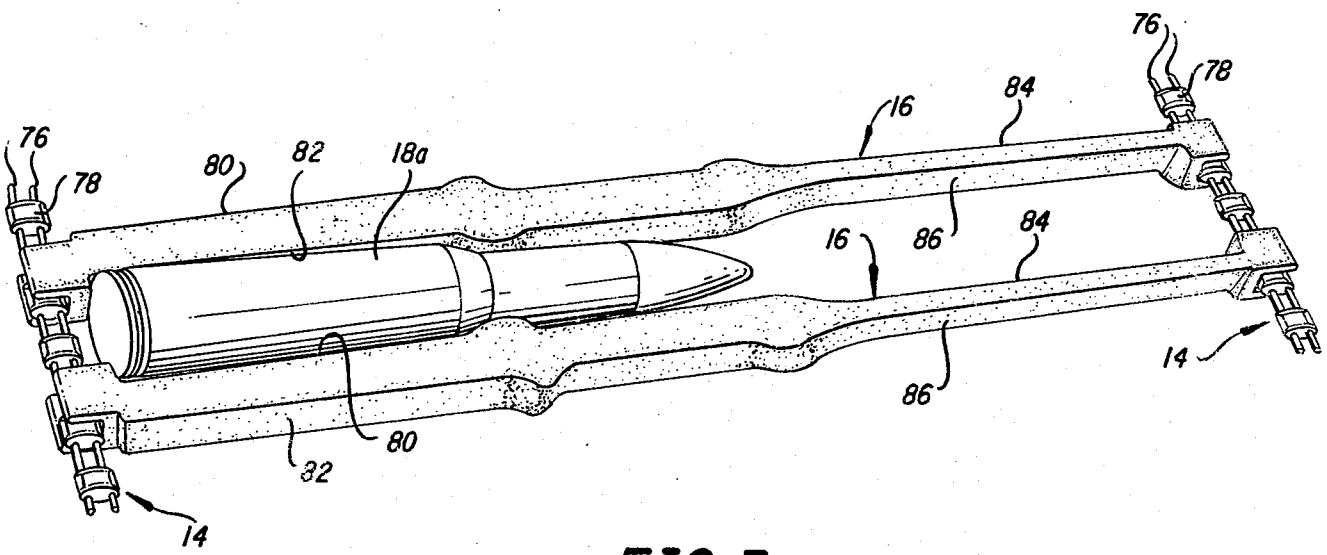
FIG. 3 is a perspective view illustrating a pair of carrier elements of the ammunition conveyor in FIG. 1 accommodating a smaller caliber of ammunition.
Figure 4:
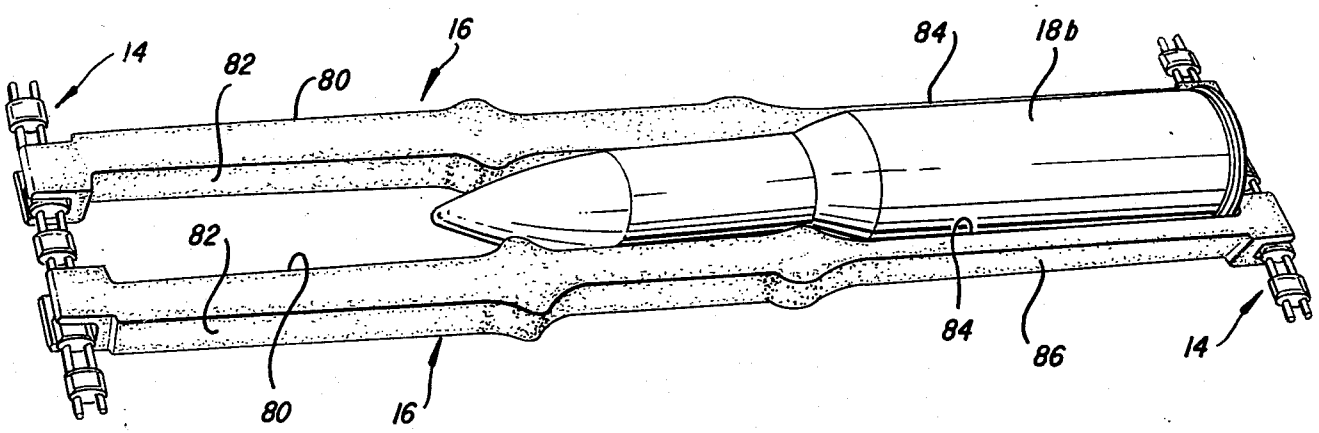
FIG. 4 is a perspective view illustrating a pair of carrier elements of the ammunition conveyor in FIG. 1 accommodating a larger caliber of ammunition.

Turning to FIGS. 3 and 4, the conveyor chains 14 are illustrated as being in the form of commercially available plastic chain each consisting of a closely spaced, parallel steel cables 76 interconnected at regular, chain link intervals by sprocket-engaging, molded plastic nubs 78. The ends of carrier elements 16 are structured for snap-fit engagement with transversely aligned nubs of the opposed chains 14 to construct ammunition conveyor 12. The carrier elements, which may be ideally formed of an injection molded, high strength plastic, are provided with opposed surface formations conforming to the profiles of the shell casings for the two calibers of ammunition rounds 18*a* and 18*b*. Thus, the left portions of the carrier elements 16 are formed with control surface formations 80 and 82 which, as presented by each carrier elements adjacent pair, closely conform to the profile of the shell casing of a 20 millimeter round 18*a*, including the neck portion thereof, as seen in FIG. 3. The spacing between these opposed control surface formations is such that either a live or spent ammunition round 18*a* is freely accepted therebetween in an axially controlled round position. To accommodate the larger, 25 millimeter ammunition rounds 18*b*, the right end portions of the carrier elements 16 are formed with control surface formations 84 and 86, which, as presented by each carrier element adjacent pair, closely conform to the larger shell casing profile. Similarly, the spacing between these opposed control surface formations is such that either a live or a spent ammunition round 18*b* is freely accepted therebetween in an axially controlled round position, as seen in FIG. 4. It will be appreciated that carrier element surfaces intermediate their control surface formations are sufficiently set back so as not to interfere with the larger 25 millimeter project accommodated in the dual caliber medial portion of the guide shelves.

From the foregoing description, it is seen that the control surface formations provided by each adjacent pair of carrier elements 16 cooperate with the guide surfaces and control surfaces of the guide shelves 38 to assure reliable conveyance of either caliber of ammunition 18*a*, 18*b* along the straight serpentine path runs of the ammunition conveyor loop path. To convert from one caliber to the other, only transfer station 32 and chuting 34, 36 have to be changed out. Moreover, since the guide shelves are simply supported on each other in stacked relation, they need not be individually attached to frame 40 (FIG. 1). Thus, they may be readily disassembled for servicing and repair. Moreover, the guide shelves may be integrally molded of high strength plastic, thus saving manufacturing expense and weight. Moreover, with plastic guiding surfaces, operation is quieter and with lower frictional losses.

While the present invention has been described in its application to an ammunition resupply system, it will be appreciated that it has application to ammunition handling or conveying systems generally. Moreover the principles of the present invention may be applied to the handling or conveying of articles other than ammunition rounds.

It is thus seen that the objects set forth above, including those made apparent from the preceding description, are efficient attained, and, since certain changes may be made in the disclosed construction without departing from the sope of the invention, it is intended that all details embodied herein be taken as illustrative and not in a limiting sense.

Having described the invention, what is claimed as new and desired to secure by Letter Patent is:

1. An article handling system comprising, in combination:

A. a pair of conveyor chains;

B. spaced sets of opposed sprockets about which said conveyor chains are engaged and trained in parallel spaced relation through a predetermined conveyor path;

C. a succession of transverse article carrier elements interconnecting said conveyor chains at regularly spaced intervals along the lengths thereof, each adjacent pair of said carrier elements providing first opposed surface formations defining therebetween a first position for accepting an article of one configuration and providing second opposed surface formations defining therebetween a second position for accepting an article of a different configuration; and D. guide means stationed along said conveyor path for maintaining articles of either configuration in their accepted positions between adjacent pairs of said carrier elements during article conveyance.

2. An article handling system defined claim 1, wherein said first and second opposed surface formations are configured to accept rounds of ammunition of two different calibers, one caliber of ammunition round to be accepted in each said first position, and a different caliber of ammunition round to be accepted in each said second position.

3. The article handling system defined in claim 2, wherein said first and second opposed surface formations are configured to control the locations of the shell casings of the ammunition rounds in either of said first and second positions, whereby to accommodate conveyance of both live and spent ammunition rounds.

4. The article handling system defined in claim 2, wherein said first and second opposed surface formations are provided at different locations along the lengths of said carrier elements.

5. The article handling system defined in claim 4, wherein said first and second opposed surface formations are further configured such that the orientation of ammunition rounds in said first positions is reversed from the orientation of ammunition rounds in said second positions.

6. The article handling system defined in claim 5, wherein said carrier elements are identically molded of plastic.

7. The article handling system defined in claim 6, wherein said carrier elements have opposed ends structured for snap-fit engagement with said conveyor chains.

8. The article handling system defined in claim 2, wherein said guide means includes a plurality of guide shelves held in stacked relation, said guide shelves including round engaging surfaces for guiding ammunition round conveyance along the plural straight runs of a serpentine conveyor path extending back and forth between adjacent pairs of said guide shelves.

9. The article handling system defined in claim 8, wherein said guide shelves include opposed sidewalls on which said guide shelves support one another in stacked relation.

10. The article handling system defined in claim 9, wherein at least one corresponding sidewall of said guide shelves is formed with interlocking surface features to inhibit transverse relative movements of said guide shelves.

11. The article handling system defined in claim 9, which further includes a frame for securing said guide shelves in stacked relation.

12. The article handling system defined in claim 9, wherein said guide shelves include extensions at at least one end for rotatably mounting one of said sprocket sets.

13. The article handling system defined in claim 9, wherein each said guide shelf includes a floor joining said opposed sidewalls, said floor supporting said round engaging surfaces.

14. The article handling system defined in claim 13, wherein at least one of said opposed sidewalls of each said guide shelf is inwardly shouldered to provide an additional round engaging surface.

15. The article handling system defined in claim 14, wherein both of said opposed sidewalls of each said guide shelf are inwardly shouldered to provide respective first and second additional round engaging surfaces, said first additional round engaging surface guiding the conveyance of ammunition rounds of said one caliber and said second additional round engaging surface guiding the conveyance of ammunition rounds of said difficult caliber.

16. The article handling system defined in claim 15, wherein said floor of each said guide shelf supports separate round engaging surfaces for guiding the conveyance of ammunition rounds of said one and said different calibers, respectively.

17. The article handling system defined in claim 16, wherein each said guide shelf further includes round control surfaces disposed in opposed, spaced relation with said round engaging surfaces of an adjacently stacked guide shelf, the ammunition rounds being conveyed along straight serpentine path runs defined between said round engaging and said round control surfaces.

18. The article handling system defined in claim 17, wherein said opposed sidewalls are inwardly formed with ledges providing running surfaces for said conveyor chains.

19. The article handling system defined in claim 18, wherein said guide shelves include extensions at least one end for rotatably mounting one of said sprocket sets.

20. The article handling system defined in claim 19, wherein each said guide shelf is of an integral construction.

21. The article handling system defined in claim 17, wherein said first and second opposed surface formations are provided at different locations along the lengths of said carrier elements.

22. The article handling system defined in claim 21, wherein said first and second opposed surface formations are further configured such that the orientation of ammunition rounds in said first positions is reversed from the orientation of ammunition rounds in said second positions.

23. The article handling system defined in claim 22, wherein said carrier elements are identically molded of plastic.

24. An article handling system comprising, in combination:

A. a pair of conveyor chains;

B. spaced sets of opposed sprockets about which said conveyor chains are engaged and trained in parallel spaced relation through a predetermined serpentine conveyor path;

C. a succession of transverse carrier elements interconnecting said conveyor chains at regularly spaced intervals along the lengths thereof, each adjacent pair of said carrier elements providing opposed surface formations defining therebetween a position for accepting an article for conveyance; and D. a plurality of guide shelves, each guide shelf including opposed sidewalls on which said guide shelves are supported one atop another in stacked relation, said guide shelves further including engaging surfaces for maintaining articles in their accepted positions and guiding article conveyance along the plural straight runs of said serpentine conveyor path back and forth between adjacent pairs of said guide shelves.

25. The article handling system defined in claim 24, wherein said engaging surfaces are configured to maintain rounds of ammunition in said accepted positions.

26. The article handling system defined in claim 25, wherein at least one corresponding sidewall of said guide shelves is formed with interlocking surface features to inhibit transverse relative movements of said guide shelves.

27. The article handling system defined in claim 25, which further includes a frame for securing said guide shelves in stacked relation.

28. The article handling system defined in claim 25, wherein said guide shelves include extensions at at least one end for rotatably mounting one of said sprocket sets.

29. The article handling system defined in claim 25, wherein each said guide shelf includes a floor joining said opposed sidewalls, said floor supporting said engaging surfaces.

30. The article handling system defined in claim 29, wherein at least one of said opposed sidewalls of each said guide shelf is inwardly shouldered to provide an additional engaging surface.

31. The article handling system defined in claim 29, wherein each said guide shelf further includes control surfaces disposed in opposed, spaced relation with said engaging surfaces of and adjacently stacked guide shelf, the ammunition rounds being conveyed along straight serpentine path runs defined between said engaging and said control surfaces.

32. The article handling system define d in claim 31, wherein said opposed sidewalls are inwardly formed with ledges providing running surfaces for said conveyor chains.

33. The article handling system defined in claim 32, wherein said guide shelves include extensions at at least one end for rotatably mounting one of said sprocket sets.

34. The article handling system defined in claim 33, wherein each said guide shelf is of an integral construction.

* * * * *